United States Patent [19]

Korver

[11] 4,019,289

[45] Apr. 26, 1977

[54] REPLACEABLE LENS SURFACING PAD WITH INTEGRAL WEAR INDICATING PATTERN

[76] Inventor: Clayton Paul Korver, 5739 Redwood Lane, Dallas, Tex. 75209

[22] Filed: Feb. 23, 1976

[21] Appl. No.: 660,339

[52] U.S. Cl. ..... 51/395; 51/209 DL; 51/DIG. 34

[51] Int. Cl.$^2$ ..... B24D 11/02

[58] Field of Search ..... 51/209 DL, 401, 406, 51/394–398, DIG. 34

[56] References Cited

UNITED STATES PATENTS

| | | | |
|---|---|---|---|
| 2,701,192 | 2/1955 | Maass | 51/DIG. 34 |
| 3,583,111 | 6/1971 | Volk | 51/DIG. 34 |
| 3,699,721 | 10/1972 | Beasley | 51/209 DL |
| 3,921,342 | 11/1975 | Day | 51/209 DL |

FOREIGN PATENTS OR APPLICATIONS

| | | | |
|---|---|---|---|
| 1,321,931 | 7/1973 | United Kingdom | 51/DIG. 34 |
| 1,379,338 | 1/1975 | United Kingdom | 51/DIG. 34 |

*Primary Examiner*—Al Lawrence Smith
*Assistant Examiner*—Nicholas P. Godici
*Attorney, Agent, or Firm*—Richards, Harris & Medlock

[57] ABSTRACT

A replaceable lens surfacing pad with integral wear indicating pattern. Pad material is conformable to the face of a lens surfacing tool and is impervious to the abrasive slurry used in fining and polishing operations in the manufacture of optical quality lenses. A wear indicating pattern is milled, embossed, or etched into the pad face which contacts the lens in association with the abrasive slurry. The pattern consists of one or more intermediate faces at one or more levels between the pad face contacting the lens and the opposite pad face bonded with pressure sensitive adhesive to the lens surfacing tool. As the lens surfacing operation progressively erodes the pad face contacting the lens, the remaining distance to one or more intermediate faces reveals the regularity or irregularity and amount of pad wear before surfacing tool damage occurs.

8 Claims, 5 Drawing Figures

REPLACEABLE LENS SURFACING PAD WITH INTEGRAL WEAR INDICATING PATTERN

BACKGROUND OF THE INVENTION

1. Field of the Invention

This invention relates to the abrasive finishing of optical quality lenses particularly regarding fining operations in the manufacture of eyeglasses.

2. Description of the Prior Art

In the past, opthalmic lenses were prepared by employing the action of abrading tools, usually of cast iron, on the lens blank in the environment of an abrasive slurry. Commonly, the abrading tool was abraded as well as the lens blank. As the operation progressed, the tooling became more defective and resultant lens became more imperfect. Costly and time consuming tool retruing was continually required. Replaceable tool facings made of materials capable of adhering and conforming to the tool face came into use for the purpose of protecting the tooling from the abrasive effects of the slurry and the lens surfacing operations. The facings permitted the curvature of the tool to be translated to the lens blank by means of the action of the abrasive slurry between the tool facing and the lens blank.

Currently used tool facings do not give indication of the amount and character of wear effects on the facing as abrasive operations progress. The result, again, is frequently damage to expensive tooling, time consuming corrective action, and imperfect lens products.

Additionally in the past, whether the surfacing tool was used with or without a facing, irregular slurry flow patterns between the tool or facing and the lens blank contributed to particular tool and facing wear problems which were translated into an imperfect lens surface. Complete absence of or inadeqate slurry flow and availability of abrasive material adversely affected abrasive action and created dry or hot spots attributable to the lack of cooling affect associated with slurry flow.

The present invention overcomes the above mentioned problems by providing a replaceable lens surfacing pad with an integral wear indicating pattern which will clearly reveal amounts and irregularities of wear to the pad before tooling damage occurs. The wear pattern further makes the working surface of the pad contacting the lens blank more accessible to slurry, thus improving slurry flow and resulting in fresh abrasive particle availability and the desired cooling affects.

BRIEF SUMMARY OF THE INVENTION

The principal object of this invention is to improve the manufacture of lenses for eyeglasses by providing an integral wear indicating pattern within a surfacing pad to make possible positive knowledge of the degree and nature of the wear on the pad during the lens fining process.

Another object of this invention is to improve the manufacture of lenses for eyeglasses by means of a surfacing pad with an integral wear indicating pattern which permits timely awareness of undesirable surfacing pad wear effects indicative of lens surface imperfections being created, and improves abrasive slurry flow to minimize or eliminate smearing or similar undesirable effects resulting from local overheating due to friction in areas of surfacing pad contact with the lens blank not subject to the cooling affect of slurry presence or flow.

DETAILED DESCRIPTION OF THE INVENTION

Figure 1:
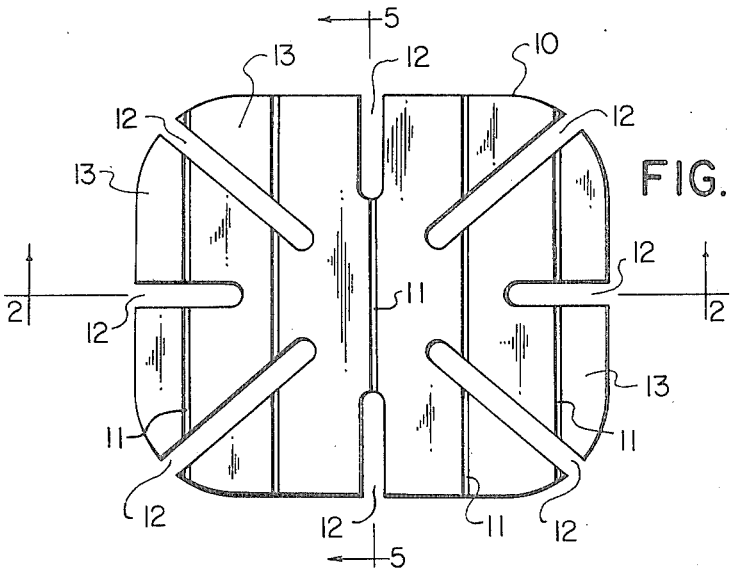
FIG. 1- is a top view of a lens surfacing pad with a wear indicating pattern of intermediate faces appearing as parallel strips.
Figure 4:
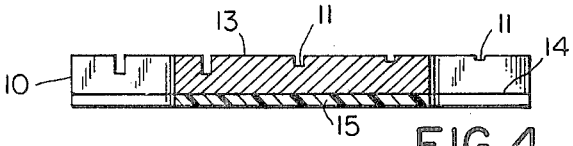
FIG. 4 is a sectional view showing wear indicating surfaces located at selected incremental distances below the working surface.

Referring to FIG. 1, surfacing pad 10 is shown in its preferred embodiment revealing first faces 13 and intermediate faces 11 created by milling, embossing, or etching parallel slots in surfacing pad 10. The plurality of intermediate faces 11 at the bottom of the milled, embossed, or etched slots constitute the wear indicating pattern which reveal by means of visual depth perception examination with reference to first faces 13, the amount and nature of pad 10 wear during lens surfacing operations.

The wear indicating pattern serves an additional important function providing passages between first faces 13 of pad 10 contacting the surface of the lens blank being worked with permit improved abrasive slurry flow. The improved slurry flow provides fresh abrasive particles and highly desirable cooling effects to the lens surfacing operation.

Figure 2:
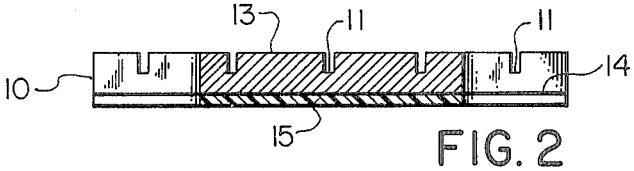
FIG. 2- is a sectional view of the surfacing pad through plane 2—2 showing the relationship of the intermediate faces comprising the wear indicating pattern to the first face and the second face of the surfacing pad.
Figure 5:
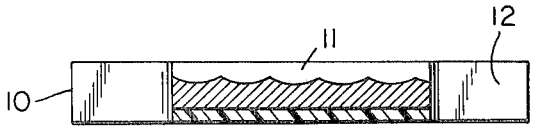
FIG. 5 is a sectional view showing intermediate surfaces which are curved.

FIG. 1- further shows relief cuts 12 customarily made in surfacing pad 10 to permit better conformance of pad 10 with the face of the surfacing tool to which it is adhesively bonded for lens surfacing. FIG. 2 is a sectional view of surfacing pad 10 showing typical spatial relationships between first face 13, intermediate faces 11 and second face 14.

In use, surfacing pad 10 is removably affixed by means of pressure sensitive adhesive layer 15 to the specially curved face of the lens surfacing tool. The surfacing tool is positioned to bring first faces 13 of pad 10 into contact with the lens blank and the surfacing operation proceeds. Periodically the grinding operator stops the surfacing operation to examine the depth and nature of pad 10 wear. If pad wear is regular but to the depth of one or more intermediate faces 13, pad 10 can be replaced before the surfacing tool is damaged. Irregular pad wear indications may require corrective action on the surface lap or tool or starting over with a corrected lap or tool.

Figure 3:
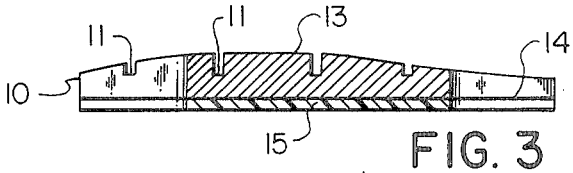
FIG. 3- is a sectional view of the surfacing pad through plane 2—2 showing wear characteristics on the first face and wear depth in relation to the intermediate faces of the surfacing pad.

FIG. 3- is the same section through surfacing pad 10 as shown in FIG. 2 during use, revealing depth and irregularity of pad wear between first face 13 and intermediate faces 11 determinable by the lens grinding operator before the abrasive material in the slurry wears through second face 14 of pad 10 resulting in damage to the special curvature of the surfacing tool face.

In the preferred embodiment, surfacing pad 10 is manufactured from high purity zinc which exhibits excellent abrasive slurry application characteristics and beneficial heat transfer affects in conjunction with the improved slurry flow permitted by the wear indicating pattern resulting from the inclusion of intermediate faces 11.

Intermediate faces 11 can be created at varying depths in surface pad 10 below first faces 13, to provide the grinding operator with specific depth of wear information. Alternatively, intermediate faces 11 can be created at one depth throughout pad 10 for general applications. It has been found for general application that intermediate faces 11 should be located at a depth of fifty per-cent of pad 10 thickness. Thus, for example, if surfacing pad 10 is 0.008 inch thick, intermediate faces 11 should be located 0.004 inch into pad 10.

Surfacing pad 10 can be manufactured from various materials similar to high purity zinc which are impervious to customarily used slurry formulations and surfacing environmental conditions such as heat. Mylar (Mylar is a registered trademark E. I. duPont de Nemours of Wilmington, Delaware) is a non-metallic material which has been found acceptable.

It should be noted that intermediate faces 11 may be created by milling, etching, embossing, pressing and other means in a variety of configurations and patterns associated with holes, grooves, slots and other geometric impressions.

It should be apparent from the above that many changes in construction and configuration of the subject invention are possible without departing from the spirit of the invention described herein and the accompanying claims.

Having thus described my invention, I claim:

1. A lens surfacing device for use between a lens to be surfaced and a smooth curved surfacing tool, comprising a replaceable homogeneous metal pad of toolable material conformable to have substantially identical curvature and configuration as said tool and having a first face for movable contact in intimate association with an abrasive slurry with the lens to be surfaced, a second face separated from and located back-to-back with said first face for removable affixation to said surfacing tool, and wear indicating means comprising depressions defining intermediate face areas of lesser surface area than said first face and located below said first face a predetermined distance beyond which wear of said pad results in imperfections being created in said lens for indicating pad wear as said first face is eroded relative to said intermediate areas during a lens fining operation.

2. The lens surfacing device of claim 1 wherein an intermediate face is located in each plane parallel to and at selected incremental distances between said first and second faces.

3. The lens surfacing device of claim 1 wherein said intermediate face is a strip across said pad in a plane parallel to said first face.

4. The lens surfacing device of claim 1 wherein said intermediate face is a curved surface.

5. The lens surfacing device of claim 1 wherein a pressure sensitive adhesive backing is applied to said second face to facilitate installation to said surfacing tool.

6. The lens surfacing device of claim 1 wherein said conformable material is zinc.

7. The combination set forth in claim 1 in which said replaceable pad is of conformable zinc material of thickness of the order of 0.008 inches.

8. The combination set forth in claim 1 wherein said pad is of homogeneous conformable zinc of about 0.008 inches thickness and said grooves are of about 0.004 inches.

* * * * *